US005769745A

United States Patent [19]

Bartoli

[11] Patent Number: 5,769,745

[45] Date of Patent: Jun. 23, 1998

[54] REMOVABLE PITCHING RUBBER

[75] Inventor: Ronald W. Bartoli, Penn Valley, Calif.

[73] Assignee: Schutt Manufacturing Co., Inc., Litchfield, Ill.

[21] Appl. No.: 744,353

[22] Filed: Nov. 4, 1996

[51] Int. Cl.[6] ..... A63B 71/00

[52] U.S. Cl. ..... 473/497

[58] Field of Search ..... 473/497, 499

[56] References Cited

U.S. PATENT DOCUMENTS

| | | | |
|---|---|---|---|
| 2,405,492 | 8/1946 | Corbett | 273/25 |
| 2,695,784 | 11/1954 | Orsatti et al. | 273/25 |
| 3,572,705 | 3/1971 | Wyble | 273/25 |
| 3,971,558 | 7/1976 | Gardetto | 273/25 |
| 4,063,729 | 12/1977 | Hollaway | 273/25 |
| 4,591,154 | 5/1986 | Santarone | 273/25 |
| 4,634,120 | 1/1987 | Hall | 273/25 |
| 4,666,155 | 5/1987 | Stille | 273/25 |
| 4,856,779 | 8/1989 | Wallendal | 473/497 |
| 4,925,186 | 5/1990 | Stevenson et al. | 273/25 |
| 4,976,430 | 12/1990 | Brandon | 273/25 |
| 5,203,557 | 4/1993 | Studebaker et al. | 473/499 |
| 5,213,323 | 5/1993 | Novinsky | 273/25 |
| 5,415,394 | 5/1995 | Hall | 273/25 |
| 5,415,395 | 5/1995 | Bartoli | 273/25 |
| 5,456,460 | 10/1995 | Larsen | 273/25 |

*Primary Examiner*—Mark S. Graham
*Attorney, Agent, or Firm*—Foley & Lardner

[57] ABSTRACT

A removable pitching rubber comprised of a pitching pad and a rigid metal plate secured to the pad, at least one metal post extending downwardly from the plate for insertion into a prearranged ground anchor embedded in the ground so as to provide a stationary mount for the pitching rubber. In one embodiment of the invention, a pair of spikes extend downwardly from the bottom of the plate relatively adjacent the ends of the plate, with the spikes, when embedded in the ground, serving to prevent the movement of the outer edges of said pitching pad and plate.

4 Claims, 1 Drawing Sheet

REMOVABLE PITCHING RUBBER

BACKGROUND

The present invention relates to a removable pitching rubber, and relates more particularly to a pitching rubber which is of high quality and durable construction and which can be mounted stationarily in the ground but readily removed following play.

Pitching mounds are traditional parts of the game of baseball and softball, and a pitching rubber is typically mounted at generally the center portion of the pitcher's mound. The pitching rubber is typically made of a hard rubber material of elongated rectangular shape, and in accordance with the rules of the games, the pitcher must be in contact with the pitching rubber while throwing the baseball or softball. The pitching rubber is therefore subjected to a high degree of wear, requiring relatively frequently replacement.

There are essentially two types of pitching rubber construction and installation. At the professional level and institutional (universities, high schools and the like) levels, the pitching rubber is typically rigidly secured to an embedded stationary support. For example, the pitching rubber can be nailed to a wood block embedded in the ground so that the pitching rubber is stationary and fixed, until wear requires replacement. In these types of installations, the quality of the pitching rubber is very important and is the highest.

In lower level recreational environments, the pitching rubber quality is ordinarily less, and the mounting less permanent. On recreational fields where use is high, it is not unusual to accommodate teams and games where the distance from the pitching rubber to home plate varies considerably. For example, for baseball, it can vary from the required 60'6", in accordance with regular baseball rules, to several lesser distances depending upon the age of the players. Where the field is used by players of varying age groups, for example, from 8–9 years of age up to 13–15 years or older, several distances from the pitching rubber to home plate are required, with smaller distances accommodating the younger players. In addition, where the field also accommodates mens' and womens' softball, still further pitching distances are involved.

In high-use recreational fields of the type described, the teams using the field at a particular time will typically bring bases and a pitching rubber, and even occasionally a home plate, to set up the field based on the playing distances. For shorter pitching distances, there are correspondingly shorter distances between the bases. After measuring the proper pitching distance and distance between home plate and the bases, the pitching rubber and bases are temporarily positioned. The pitching rubber typically has 3 or 4 nail spikes extending from the bottom surface of the pitching rubber by means of which the rubber can be properly positioned for play and easily removed after play. The pitching rubber is inexpensive and can best be described as being a relatively low performance item.

It should be noted that there is no absolute requirement for removal of the pitching rubbers, and up to four or five rubbers could be installed in the manner described and left in place in order to accommodate various pitching distances. However, in such event the pitching rubbers tend to affect the play of the game and also make it difficult to properly drag and prepare the field for play.

For all of the reasons indicated above, there has been a great need to provide a high quality pitching rubber which can be stationarily but removably mounted at various pitching distances to accommodate different game requirements.

SUMMARY OF THE INVENTION

With the above in mind, a principal feature of the present invention is the provision of a high quality and relatively long lasting pitching rubber which can be firmly and stationarily mounted on the pitching mound during use but easily removed following play. The stationary mounting includes a sleeve or stanchion which forms part of the pitching rubber assembly and which extends downwardly and is received by an embedded ground anchor. The ground anchor typically has an opening which is square or rectangular in cross section, with the sleeve or stanchion being similarly configured, whereby positioning the stanchion in the ground anchor prevents rotation of the pitching rubber relative to the embedded ground anchor.

In order to accommodate different pitching rubber distances from home plate, a series of ground anchors can be embedded at varying distances from home plate and suitably covered when not in use, for example, by ground anchor plugs. These plugs are well known in the art and form no part of the present invention, with the plugs serving not only to identify the location of the ground anchor but also preventing water or dirt from entering the ground anchor opening.

Where a series of spaced ground anchors are provided, teams using the field simply pick the proper pitching mound distance and remove the ground anchor plug for the ground anchor having the appropriate distance from home plate. The pitching rubber can then be inserted in the ground anchor for play, and removed after play, with the plug again being positioned in the ground anchor opening.

A further feature of the invention is the quality of the pitching rubber itself. In order to substantially strengthen the pitching rubber, a rigid metal plate is secured to the bottom surface of the pitching rubber pad, for example, by bonding whereby the metal plate and the pitching pad stay firmly secured during use. However, in the event it is desired to replace the rubber pad after excess wear, the rubber pad can be separated from the plate.

A further feature of the invention is the provision on the metal plate of downwardly extending side lips or flanges. When the pitching rubber is installed in the ground anchor, these lips penetrate the ground and serve as stabilizers at the front and rear edges of the pitching rubber to prevent tilting of the rubber in any direction.

In one form of the invention, a single stanchion is provided, affixed, by welding, for example, to the bottom of the plate. A pair of spikes are positioned between the stanchion and the ends of the pitching rubber. The spikes can be driven into the ground when the stanchion is inserted in the ground anchor, and serve to stabilize the mounting of the rubber at each end. The spikes serve the further function of securing the pitching rubber to the metal plate. The spikes are provided with threaded upper end portions which extend through threaded openings in the metal plate into threaded engagement with nuts embedded in the pitching pad, preferably during the molding process. The spikes thus serve to rigidly clamp the pitching rubber to the plate thereby providing a rigid unitary construction. When it is desired to replace the rubber due to wear, the spikes can be withdrawn from threaded engagement with the nuts embedded in the pitching rubber, thereby permitting the pitching pad to be removed if necessary for replacement.

In an alternative embodiment of the invention, a pair of longitudinally spaced ground anchors are embedded in the ground at the or each pitching distance. The metal plate of the pitching rubber has rigidly secured thereto two stanchions corresponding in configuration and spacing to the spacing of the ground anchors. The insertion of the stanchions into the ground anchors serves to provide a very stable mounting which essentially resists tilting of the rubber in any direction. The pitching rubber can be removed by lifting the same upwardly from its mounting in the ground anchors.

The removable pitching rubber according to one embodiment of the present invention can be generally described as comprising a pitching pad securely mounted to a rigid metal plate similar in length and width to the pitching pad, with a metal stanchion or post extending downwardly from the plate and adapted to be received in a prearranged ground anchor embedded in the ground so as to provide a stationary mount for the pitching rubber. A pair of spikes extend downwardly from the bottom of the plate between the stanchion and the ends of the plate and can be driven into the ground when the stanchion is inserted into the ground anchor, which spikes serve to stabilize the mounting and prevent the movement of the outer edges of the pitching rubber.

The invention can also be described as comprising a pitching pad securely mounted to a rigid metal plate of similar length and width, with longitudinally spaced metal stanchions or posts extending downwardly from the plate and adapted to be removably received in prearranged ground anchors embedded in the ground to provide a stationary, removable mount for the pitching rubber.

The invention can be further described as comprising a pitching pad, a rigid metal plate secured to the bottom of the pitching pad and provided with downwardly turned lips at each longitudinal edge for penetrating the ground when the pitching rubber is installed, and at least one metal stanchion secured to and extending downwardly from the plate and adapted to be removably inserted into a prearranged ground anchor embedded in the ground to provide a stationary, removable mount for the pitching rubber.

These and other features and objects of the invention will be apparent as the following description proceeds with particular reference to the application drawing.

BRIEF DESCRIPTION OF THE APPLICATION DRAWING

In the application drawing.

DETAILED DESCRIPTION OF THE PREFERRED EMBODIMENTS

Figure 1:
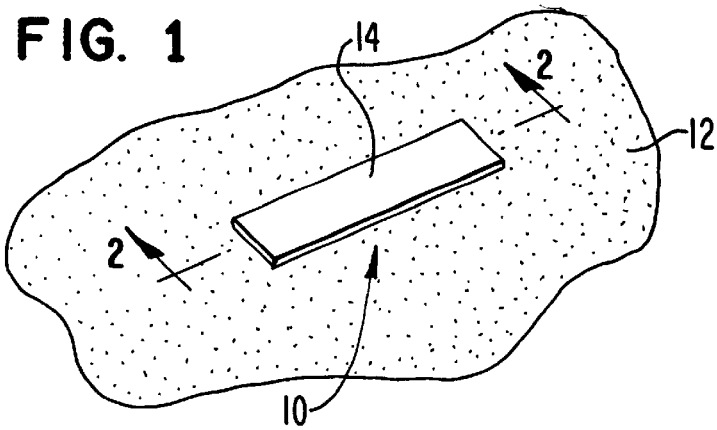
FIG. 1 is a top respective view showing the pitching rubber of the present invention installed for play.

Referring in more detail to the application drawing, wherein like parts are indicated by like reference numerals, the pitching rubber constructed in accordance with the present invention is generally indicated at 10 and is shown in FIG. 1 in an installed position on a pitching mound 12. The pitching pad 14 is normally exposed slightly above ground level. The pitching pad per se forms no part of the present invention, but preferably is formed of an elastic material such as hard rubber, meeting the specifications of professional play. The use of a high quality pitching pad ensures as long a useful life as possible before damage or routine wear requires that the pad be replaced.

Figure 2:
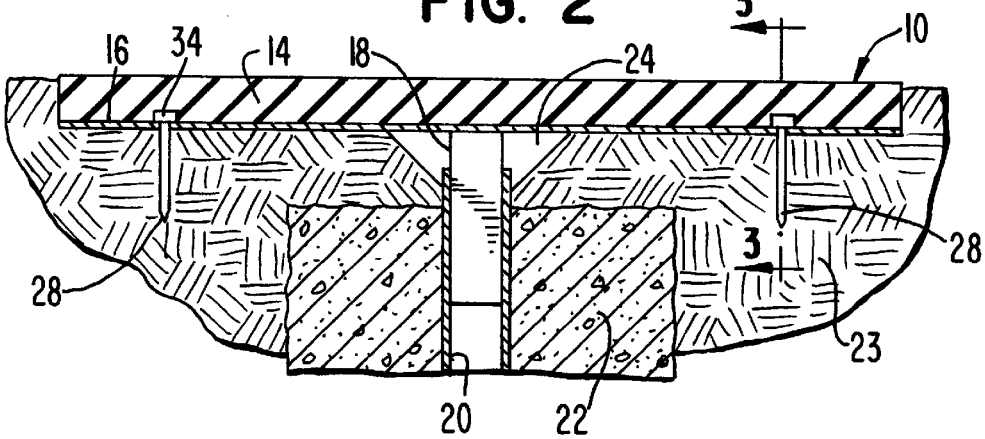
FIG. 2 is a fragmentary vertical sectional view taken on line 2—2 of FIG. 1.
Figure 3:
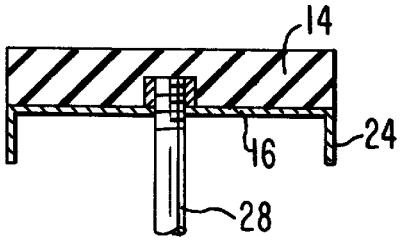
FIG. 3 is a vertical sectional view taken on line 3—3 of FIG. 2.
Figure 4:
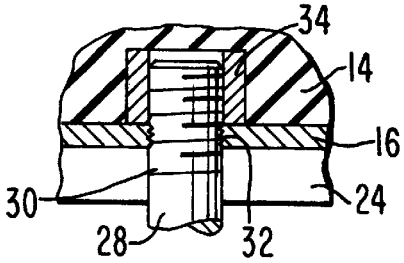
FIG. 4 is an enlarged fragmentary view showing the connection of one of the spikes to the pitching pad and metal plate.

Referring to FIGS. 2–4, the pitching pad 14 is secured to a metal plate 16 which is coextensive in length and width with the pitching pad. The plate is preferably formed of steel and can be bonded to the pad during the molding of the pad, or thereafter. The precise thickness of the steel plate is not critical to the present invention, although the thickness must be such that there is no tendency for the plate to bend when the pitching rubber is removed from position.

A stanchion or post 18 is secured to the bottom of the metal plate approximately in the longitudinal and transverse center of the plate. The stanchion is of metal, preferably steel, and can be secured to the bottom of the plate by any suitable means, such as, for example, welding or the like. The stanchion is preferably a hollow sleeve, and more preferably square or rectangular in cross-section to prevent rotation of the pitching rubber when installed.

A ground anchor 20 is embedded in the ground where the pitching rubber is to be installed, with the ground anchor typically comprising a hollow sleeve similar in cross-sectional configuration to the cross-sectional shape of the stanchion 18. In order to provide a rigid, stationary mounting for the pitching rubber, the ground anchor 20 is preferably embedded in concrete 22 which, when set, provides a permanent mounting for the ground anchor. The upper end of the ground anchor normally terminates a slight distance below the level of the pitcher's mound, and is covered by dirt 23 which forms the pitching mound. When the pitching rubber is installed by inserting the stanchion downwardly into the ground anchor, the pitching rubber engages the ground for supporting the pitching rubber across its entire cross-sectional area. The stanchion and ground anchor per se form no part of the present invention and are typically used in base installations at the professional and advanced amateur levels.

In order to provide support and stability to the pitching rubber, the metal plate 16 is formed with side lips or flanges commonly designated at 24 which preferably extend throughout the length of the plate at each longitudinal side thereof. When the pitching rubber is installed for play, the lips 24 penetrate the ground along the full length of the lips, and serve to prevent twisting or tilting of the pitching rubber, thereby further stabilizing the pitching rubber.

In the FIG. 2 embodiment, spikes commonly designated at 28 are preferably provided relatively adjacent each end of the pitching rubber, for the purpose of preventing the ends of the pitching rubber from moving, thereby stabilizing the installation. The spikes 28 serve the further purpose of securing the pitching pad 14 to the plate 16. Referring to FIGS. 3 and 4, the upper end of each spike 28 is provided with threads 30 which are adapted to engage the threads of a threaded opening 32 formed in the metal plate, above which is positioned an internally threaded nut 34 preferably molded in the pitching pad during the molding operation. When the spike 28 is threaded upwardly through the opening 32 of the plate into engagement with the nut 34, the connection clamps the pitching pad to the plate 16 until the spikes are removed, for example, when it is desired to replace the pitching pad due to damage or wear. The bottoms of the spikes 28 penetrate the ground in the area adjacent each end of the pitching rubber thereby to provide additional support in such areas and prevent the outer edges of the pitching rubber from moving. In combination with the stanchion and ground anchor mounting, and the lips 24 formed on the plate 16, a very stable mounting for the pitching rubber is provided.

Figure 5:
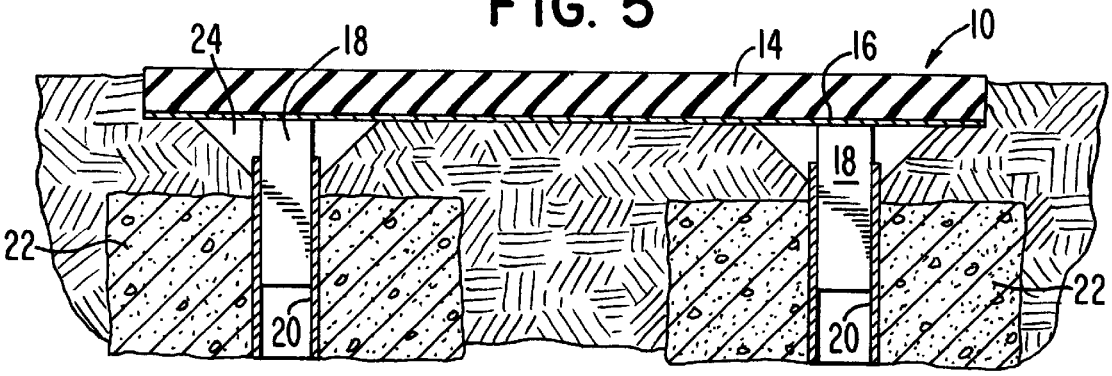
FIG. 5 is a vertical cross-sectional view similar to FIG. 2 but showing an alternative embodiment of the invention in which two stanchion and ground anchor assemblies are utilized.

FIG. 5 shows an alternative embodiment of the invention in which two spaced stanchion and ground anchor assemblies are provided, with each identified by the same reference numerals used in FIGS. 2–4. The ground anchors 20 are longitudinally spaced to support the pitching rubber relatively adjacent each end thereof so as to prevent movement at such ends. Moreover, the provision of two spaced stanchion and ground anchor assemblies prevents tilting or twisting movement along the entire length of the pitching rubber, even in the middle portion thereof intermediate the stanchions and ground anchors. In the FIG. 5 embodiment, it is similarly preferred that the metal plate 16 be formed with the longitudinal lips or flanges 24 so that the pitching rubber when installed is further stabilized. It is imperative that the ground anchors when installed are aligned and spaced apart the same distance as the spacing of the stanchions 18 in order to permit installation of the pitching rubber. Spikes 28 are not necessary in the FIG. 5 embodiment to stabilize the ends of the pitching rubber, but can be used if desired to augment the connection of the pad to the plate.

Between uses of the pitching rubber in either the FIG. 2 or FIG. 5 embodiments, the ground anchor sleeve is preferably covered with a locator plug of some type. Such a plug typically includes a stem or shaft which extends downwardly into the ground anchor, and a body portion which is larger in area than the upper exposed end of the ground anchor so that the edges of the anchor are covered. Since most ground anchors are square in cross-sectional configuration, the cross-sectional shape of the shaft or stem is similarly square and dimensioned to fit within the ground anchor. The ground anchor plug serves to locate the ground anchor(s) and functions further to prevent dirt or debris and rain or moisture from entering the ground anchor. There are several types of locator plugs commercially available, and the plug per se forms no part of the present invention and has accordingly not been illustrated.

The manner in which the pitching rubber in accordance with the present invention is installed and removed should be apparent from the above description. When it is desired to install the pitching rubber embodiment illustrated in FIG. 2, when the appropriate ground anchor is located, the locator plug is removed and the pitching rubber installed by aligning the stanchion 18 with the ground anchor sleeve 20. The pitching rubber is then moved downwardly until the bottom surface of the plate 16 engages the ground. During such downward movement, the spikes 28 and the lips 24 of the metal plate penetrate the ground thereby providing additional support for the mounting and preventing twisting or turning of the pitching rubber.

In the use of the FIG. 5 environment, essentially the same described procedures are followed, except two laterally aligned ground anchors must be located, both normally covered by a locator plug. Since the ground anchors when installed are aligned and spaced the required distance, the removal of the locator plugs permits the stanchions 18 to be inserted downwardly into the ground anchor sleeves, with the lips 24 penetrating the ground as the pitching rubber is moved downwardly. The double stanchion embodiment of FIG. 5 eliminates the need for the spikes 28 of the FIG. 2 embodiment, with the stanchions preventing movement of each end of the pitching rubber as well as intermediate portion therebetween. In the FIG. 5 form, the pitching pad can be secured to the metal plate 16 in any suitable manner, for example, by bonding either during or after the molding operation or by any other means there who are experienced in the art.

To remove the pitching rubber after play has finished, all that in necessary is to dislodge at least to some extent the embedded lips 24, and to thereafter raise the pitching rubber to separate the stanchions from the ground anchors. When this has been done, locator plugs can be mounted in the exposed upper ends of the ground anchor sleeves.

The several advantages of the present invention should be apparent from the foregoing description. The removable pitching rubber can be positioned in the appropriate ground anchor depending on the rule requirements of the particular game being played. After use, the pitching rubber is simply removed and stored for later use. The ground anchors when not in use are covered by locator plugs which do not, interfere with play in the field or pitching from another distance. An important feature is the provision of a high quality pitching rubber that can endure long periods of use before replacement of the pitching pad is necessary.

It will be understood that the foregoing description and the accompanying drawing are for illustrative purposes only. Various modifications of the invention will be apparent to those skilled in the art. For example, rather than embedding the nuts 34 in the pad, they could be secured by welding or the like to the underside of the plate 16. This arrangement eliminates the need for providing threaded openings 32 in the plate, with the threaded ends of the spikes when fully extended contacting the bottom surface of the plate. In such an arrangement, the spikes serve no connecting function between the pitching pad and the plate.

What is claimed is:

1. A removable pitching rubber adapted to be firmly but removably mounted in the ground, comprising:

a pitching pad securely but removably mounted to a rigid metal plate, said pad and said plate being of similar length and width, a metal post extending downwardly from said plate and adapted to be inserted into a prearranged ground anchor embedded in the ground so as to provide a stationary mount for said pitching rubber, and a pair of spikes extending downwardly from the bottom of said plate between said metal post and ends of said plate, said spikes, when embedded in the ground, serving to prevent the movement of outer edges of said pitching pad and said plate, each of said spikes being formed with a threaded upper end which extends through a threaded opening in said plate into an internally threaded nut mounted in the bottom surface of said pitching pad, the spikes serving when threadedly engaged to firmly secure said pitching pad to said plate in the area of said spikes, but when threadedly disengaged to permit separation of the pad from the plate for replacement of the pad as desired.

2. The pitching rubber of claim 1, wherein said metal plate has longitudinal edges and is formed with a downwardly turned lip at each longitudinal edge, the lips when said rubber is installed penetrating the ground and stabilizing the rubber at the edges thereof.

3. A removable pitching rubber adapted to be firmly but removably mounted in the ground, comprising:

a pitching pad comprising an exposed upper portion of the pitching rubber, a rigid metal plate secured to the bottom of said pitching pad, said plate being provided with downwardly turned lips at longitudinal edges for penetrating the ground when the pitching rubber is installed, at least one metal stanchion secured to and extending downwardly from said plate and adapted to be removably inserted into a prearranged ground anchor embedded in the ground to provide a stationary, removable mount for said pitching rubber, and a pair of spikes extending downwardly from the bottom of said plate between said stanchion and ends of said plate, said spikes serving to stabilize the rubber when mounted, the spikes at upper ends thereof being threaded and adapted to be received in threaded openings formed in the plate and internally threaded nuts embedded in the bottom surface or the pad.

4. A removable pitching rubber adapted to be firmly but removably mounted in the ground, comprising:

a pitching pad securely but removably mounted to a rigid metal plate, said pad and said plate being of similar length and width, a metal post extending downwardly from said plate and adapted to be inserted into a prearranged fixed ground anchor embedded in the ground so as to provide a stationary mount for said pitching rubber, a pair of spikes extending downwardly from the bottom of said plate between said metal post and ends of said plate, said spikes, when embedded in the ground, serving to prevent the movement of outer edges of said pitching pad and said plate, and wherein said metal plate having longitudinal edges and formed with a downwardly turned lip at each longitudinal edge, the lips, when the removable rubber is positioned in the fixed ground anchor, penetrating the ground and stabilizing the rubber at the edges thereof.

* * * * *